US005381685A

United States Patent [19]

Carl et al.

[11] Patent Number: 5,381,685

[45] Date of Patent: * Jan. 17, 1995

[54] COMPUTER PHYSICAL SECURITY DEVICE

[75] Inventors: Stewart R. Carl, Palo Alto; Arthur H. Zarnowitz, Burlingame, both of Calif.; Gary L. Myers, River Grove, Ill.

[73] Assignee: Kensington Microware Limited, San Mateo, Calif.

[ * ] Notice: The portion of the term of this patent subsequent to Jul. 12, 2011 has been disclaimed.

[21] Appl. No.: 42,851

[22] Filed: Apr. 5, 1993

Related U.S. Application Data

[63] Continuation of Ser. No. 824,964, Jan. 24, 1992, abandoned.

[51] Int. Cl.[6] ..... E05B 65/00

[52] U.S. Cl. ..... 70/78; 70/14; 70/57; 70/491; 248/553

[58] Field of Search ..... 70/57, 58, 14, 18, 30, 70/49, 232, 491; 248/551, 553, 505

[56] References Cited

U.S. PATENT DOCUMENTS

| | | | |
|---|---|---|---|
| 1,452,471 | 4/1923 | Kline . | |
| 2,480,662 | 8/1949 | McKinzie . | |
| 2,594,012 | 4/1952 | Griffin | 220/55 |
| 2,677,261 | 5/1954 | Jacobi | 70/14 |
| 2,729,418 | 1/1956 | Maynard . | |
| 2,800,090 | 7/1957 | Reid | 109/59 |
| 3,136,017 | 6/1964 | Preziosi | 411/543 |
| 3,276,835 | 10/1966 | Hall | 312/333 |
| 3,469,874 | 9/1969 | Mercurio . | |
| 3,664,163 | 5/1972 | Foote . | |
| 3,727,934 | 4/1973 | Averbook et al. . | |
| 3,785,183 | 1/1974 | Sander | 70/58 |
| 3,859,826 | 1/1975 | Singer et al. | 70/371 |
| 3,866,873 | 2/1975 | Bohli . | |

(List continued on next page.)

FOREIGN PATENT DOCUMENTS 987121 4/1976 Canada .

OTHER PUBLICATIONS

Kablit Security System Catalog, pp. 7, 93, 1988.

*Computer and Office Equipment Security Catalog*, ©1990 by Secure-It, Inc., 18 Maple Court, East Longmeadow, Mass. 01028.

Kensington Product Brochure for Kensington Apple ®, LaserWriter ® and Macintosh ® Portable Security Systems.

*Primary Examiner*—Lloyd A. Gall
*Assistant Examiner*—Darnell M. Boucher
*Attorney, Agent, or Firm*—Townsend and Townsend Khourie and Crew

[57] ABSTRACT

An apparatus which inhibits the theft of equipment such as personal computers is disclosed. The equipment must have an external wall provided with a specially designed, approximately rectangular slot having preselected dimensions. An attachment mechanism includes a housing for a spindle having a first portion rotatable within the housing, a shaft extending outwardly from the housing, and a crossmember at the end of the shaft having peripheral dimensions closely conforming to the internal dimensions of the slot. An abutment mechanism also emanates from the housing, and is located on opposite sides of the shaft intermediate the housing and the crossmember. The peripheral cross-sectional dimensions of the abutment mechanism and the shaft in combination closely conform to the dimensions of the slot. The length of the shaft from the housing to the crossmember is approximately equal to the thickness of the external wall of equipment. The crossmember is aligned with the abutment mechanism so that the crossmember can be inserted through the slot with the shaft and the abutment mechanism occupying the slot. The spindle is then rotated 90° to misalign the crossmember with the slot, thereby attaching the attachment mechanism rigidly to the external wall. A cable is secured to the housing and to an immovable object so that the equipment cannot be stolen.

19 Claims, 4 Drawing Sheets

U.S. PATENT DOCUMENTS

| | | | |
|---|---|---|---|
| 4,004,440 | 1/1977 | Dreyer . | |
| 4,028,913 | 6/1977 | Falk . | |
| 4,057,984 | 11/1977 | Avaiusini | 70/58 |
| 4,065,083 | 12/1977 | Gassaway . | |
| 4,131,001 | 12/1978 | Gotto | 70/14 |
| 4,212,175 | 7/1980 | Zakow . | |
| 4,223,542 | 9/1980 | Basseches . | |
| 4,252,007 | 2/1981 | Kerley . | |
| 4,311,883 | 1/1982 | Kidney | 179/189 |
| 4,462,233 | 7/1984 | Horetzke | 70/428 |
| 4,527,405 | 7/1985 | Renick | 70/14 |
| 4,570,465 | 2/1986 | Bennett . | |
| 4,584,856 | 4/1986 | Petersdorff | 70/57 |
| 4,616,490 | 10/1986 | Robbins | 70/14 |
| 4,640,106 | 2/1987 | Derman | 70/14 |
| 4,655,057 | 4/1987 | Derman | 70/14 |
| 4,685,312 | 8/1987 | Lakoski | 70/14 |
| 4,691,891 | 9/1987 | Dionne . | |
| 4,733,840 | 3/1988 | D'Amore . | |
| 4,738,428 | 4/1988 | Themistos et al. . | |
| 4,826,193 | 5/1989 | Davis . | |
| 4,842,912 | 6/1989 | Hutter, III . | |
| 4,843,848 | 7/1989 | Igelmund . | |
| 4,856,304 | 8/1989 | Derman | 70/14 |
| 4,858,455 | 8/1989 | Kuo | 70/491 |
| 4,907,716 | 3/1990 | Wankel et al. | 70/360 |
| 4,918,952 | 4/1990 | Lakoski | 70/57 |
| 4,938,040 | 7/1990 | Humphreys, Jr. | 70/58 |
| 4,959,979 | 10/1990 | Filipow | 70/58 |
| 4,979,382 | 12/1990 | Perry . | |
| 4,985,695 | 1/1991 | Wilkinson et al. | 70/58 |
| 4,993,244 | 2/1991 | Osman . | |
| 5,050,836 | 9/1991 | Makous . | |
| 5,082,232 | 1/1992 | Wilson | 248/551 |
| 5,119,649 | 6/1992 | Spence | 70/14 |
| 5,197,706 | 3/1993 | Braithwaite et al. . | |
| 5,327,752 | 7/1994 | Myers et al. | 70/57 |

COMPUTER PHYSICAL SECURITY DEVICE

This is a continuation of application Ser. No. 07/824,964, filed Jan. 24, 1992, now abandoned.

BACKGROUND OF THE INVENTION

The present invention relates to devices for inhibiting the theft of relatively small but expensive pieces Computers have evolved rather rapidly from large, expensive machines usable only by a few, to relatively small, portable machines which are usable by many. In particular, the development of desk top computers with significant processing power has made computers available to the general population. It is now common for college and even high school students to have their own computer, and desk top computers are in wide spread use as word processors and work stations in almost all forms of business. Desk top computers are relatively small and easily transportable, and an undesirable side effect of their proliferation is the fact that the theft of such computers is a significant problem.

A variety of devices have been developed to inhibit the theft of desk top computers and similar equipment. Since desk top computer systems involve several components, typically including the computer itself, a separate monitor, keyboard and often a printer, such security systems often employ a cable which attaches each of the components to each other and to a relatively immovable object such as a desk. The principal difficulty in such systems is providing an effective and convenient method for attaching the cable itself to the equipment.

Kensington Microware Limited, assignee of this application, currently provides a security system which is especially designed for use with particular Apple computers. Certain Apple computer components have slots and internal brackets designed to capture a specially designed tab inserted through the slot so that the tab is not removable. While this system is effective for particular types of Apple computers, it does not work for those Apple computer components and other computer brands which do not have the special designed slots and brackets.

It is undesirable to require a computer to have specially designed slots and internal capture brackets because the brackets occupy a significant amount of space in an item of equipment which is intended to be as space efficient as possible. Different items of Apple equipment require different sized slots, meaning that the security mechanism must provide a variety of different sized tabs. The tabs, once inserted cannot be removed without damage to the equipment, meaning that the security system cannot be moved from one computer to the other. Even Apple computers with specially designed slots are typically used with peripheral equipment which does not have them, and, the Kensington system provides screws requiring a special screwdriver which replace the screws used to attach the existing communication cables, securing the peripheral equipment to the base computer by preventing unauthorized removal of the communication cables. This last aspect of the system has the obvious deficiency that the peripheral equipment cannot be removed from the base computer without the special screwdriver, which can be lost or misplaced.

Other vendors provide security systems which are not required to interface directly with special slots and capture mechanisms as provided in certain Apple computers. For example, Secure-It, Inc., under the trademark "KABLIT", provides a variety of brackets attached to the computer component using existing mounting screws, i.e., screws which are already used to secure items of equipment within the cabinet. Typically, the bracket is apertured so that passage of the cable through the aperture prevents access to the mounting screw and thus prevents removal of the bracket from the equipment. A deficiency of this type of system is that it requires the removal of the existing mounting screw, which may cause some damage to the internal components of the computer. Suitable existing screws are not always available on certain peripherals for convenient attachment of the fastener. For this latter reason, KABLIT also provides glue-on disks which, unfortunately, are permanently secured to the equipment. The theft of small but expensive equipment such as desk top computers is a growing problem. Existing devices are simply too inefficient or ineffective, or their application is too limited. As a result, the use of such security systems is rare, computer equipment is typically left unprotected, and it is all too often stolen.

SUMMARY OF THE INVENTION

The present invention provides apparatus which inhibits the theft of equipment such as personal computers. The equipment must have an external wall provided with a specially designed, approximately rectangular slot having preselected dimensions. An attachment mechanism includes a housing for a spindle having a first portion rotatable within the housing, a shaft extending outwardly from the housing, and crossmember at the end of the shaft having peripheral dimensions closely conforming to the internal dimensions of the slot. An abutment mechanism also emanates from the housing, and is located on opposite sides of the shaft intermediate the housing and the crossmember. The peripheral cross-sectional dimensions of the abutment mechanism and the shaft in combination closely conform to the dimensions of the slot. The length of the shaft from the housing to the crossmember is approximately equal to the thickness of the external wall of equipment. The crossmember is aligned with the abutment mechanism so that the crossmember can be inserted through the slot with the shaft and the abutment mechanism occupying the slot. The spindle is then rotated 90° to misalign the crossmember with the slot, thereby attaching the attachment mechanism rigidly to the external wall. A cable is secured to the housing and to an immovable object so that the equipment cannot be stolen.

The apparatus of the present invention is far more adaptable and convenient to use than existing systems. The only required modification of the equipment to be protected is a small (preferably about 3 by 7 millimeter) slot in an external wall. Additional brackets, capture mechanisms or the like are not necessary. This small slot can easily be molded into computer systems at essentially no cost and without degrading the integrity of the equipment. The attachment mechanism can readily be installed on the equipment, and removed when appropriate by an authorized user. In one embodiment, a key-operated attachment attaches a single item of equipment to an immovable object with the cable. In a second embodiment, the cable passes through mating apertures in the spindle and the housing of one or more attachment mechanisms to prevent their removal once they have been attached to the equipment and the cable has been installed.

The attachment mechanism of the present invention is surprisingly difficult to remove from an item of equipment once it has been installed. In the preferred embodiments, the mechanism is quite small, and it is difficult to apply sufficient leverage to break the mechanism away from the equipment to which it is attached. Forcibly removing the mechanism will result in significant, highly visible damage to the exterior wall, identifying the equipment as stolen and making it difficult to resell, greatly reducing its theft potential.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however,that the drawings are for the purpose of illustration and description only and are not intended as a definition of the limits of the invention.

DESCRIPTION OF THE PREFERRED EMBODIMENTS

Figure 1:
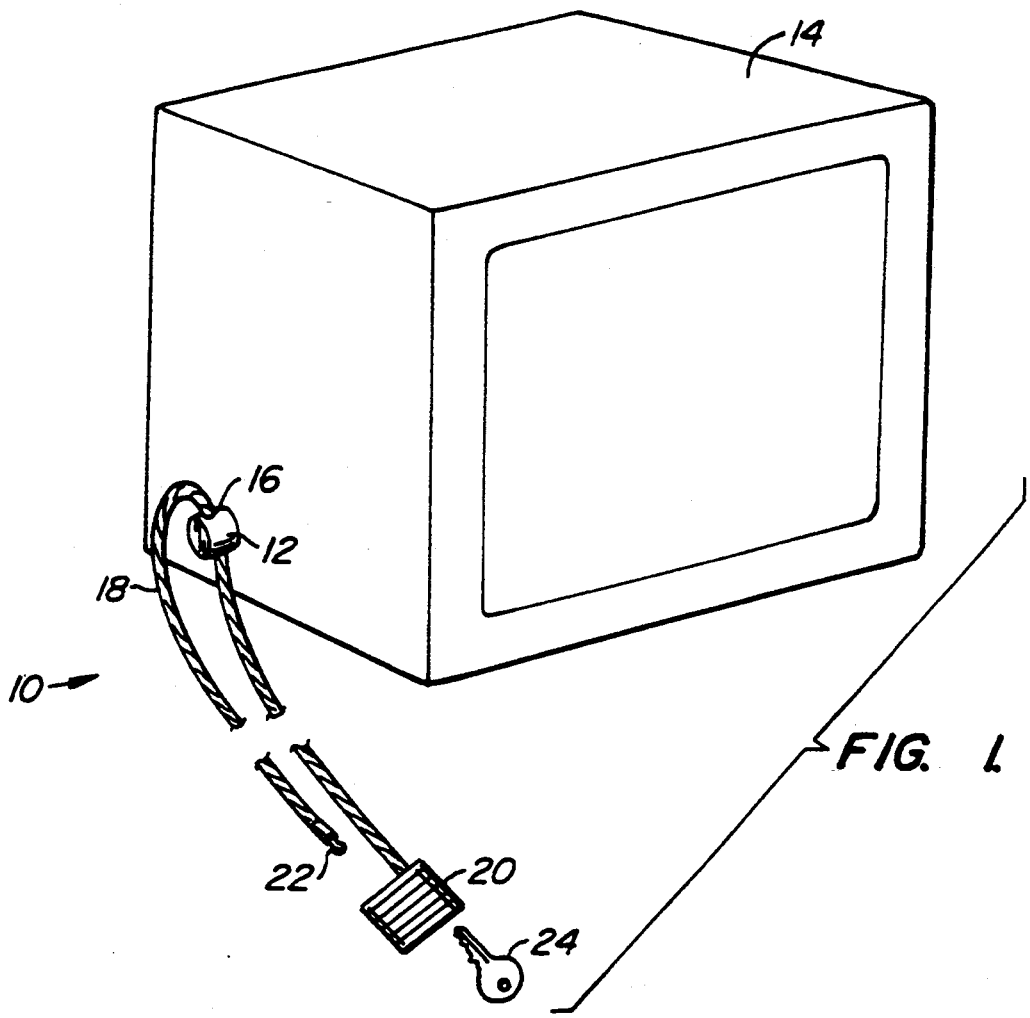
FIG. 1 is a perspective view of a first embodiment of the present invention attached to a computer monitor.

A first preferred embodiment 10 of the security device of the present invention is illustrated generally by way of reference to FIG. 1. Security device 10 includes an attachment mechanism 12 designed to attach to a component of a computer system, such as computer monitor 14. Attachment mechanism 12 has an aperture 16, and an object such as a cable 18 which passes through the aperture when the attachment mechanism 12 is attached to a component such as monitor 14. A lock 20 is fixed to one end of cable 18. The free end of cable 18 may be of the type having a "mushroom" head 22 adapted to penetrate and be secured within lock 20 using key 24. With mushroom head 22 detached from lock 20, cable 18 can be threaded through the apertures 16 of one or more attachment mechanisms 12, and wrapped around a relatively immovable object (not shown) such as the cross bar spanning two legs of a desk. Mushroom head 22 is then inserted into lock 20 and the lock closed using key 24 to secure the computer components to the immovable object.

Figure 2:
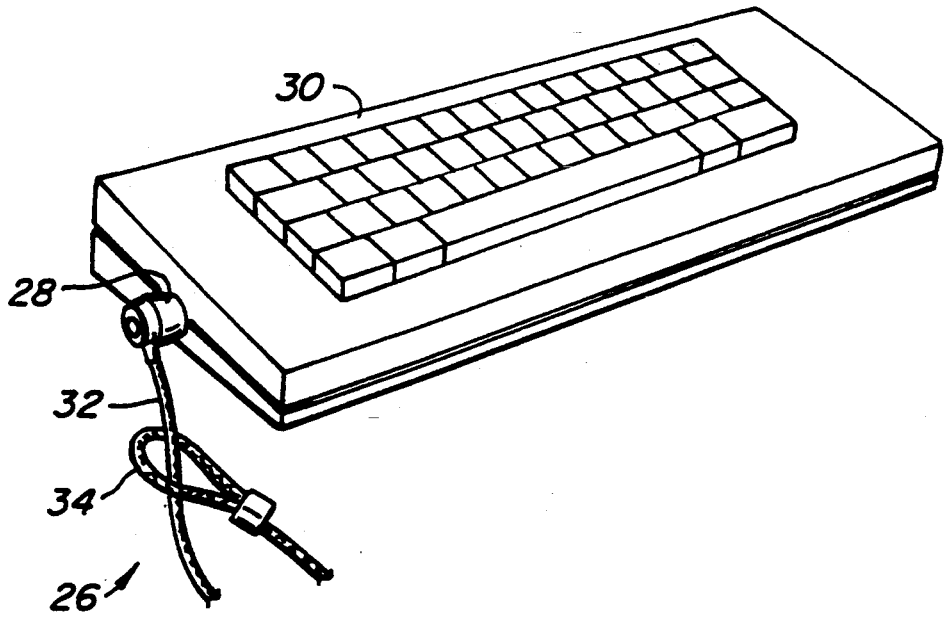
FIG. 2 is a perspective view of a second embodiment of the present invention attached to a computer keyboard.

A second embodiment 26 of the present invention, designed primarily to secure single rather than multiple items of computer equipment, is illustrated generally by way of reference to FIG. 2. Embodiment 26 includes an attachment mechanism 28 designed to be secured to a computer component such as keyboard 30. Attachment mechanism 28 is affixed to the end of a cable 32 which has a closed loop 34 at its other end. Cable 32 is first wrapped around a relatively immovable object, such as a cross piece between two legs of a desk or table, and attachment mechanism 28 is passed through loop 34 and attached to the item to be protected such as keyboard 30 to make it difficult to steal the item of equipment.

Figure 4:
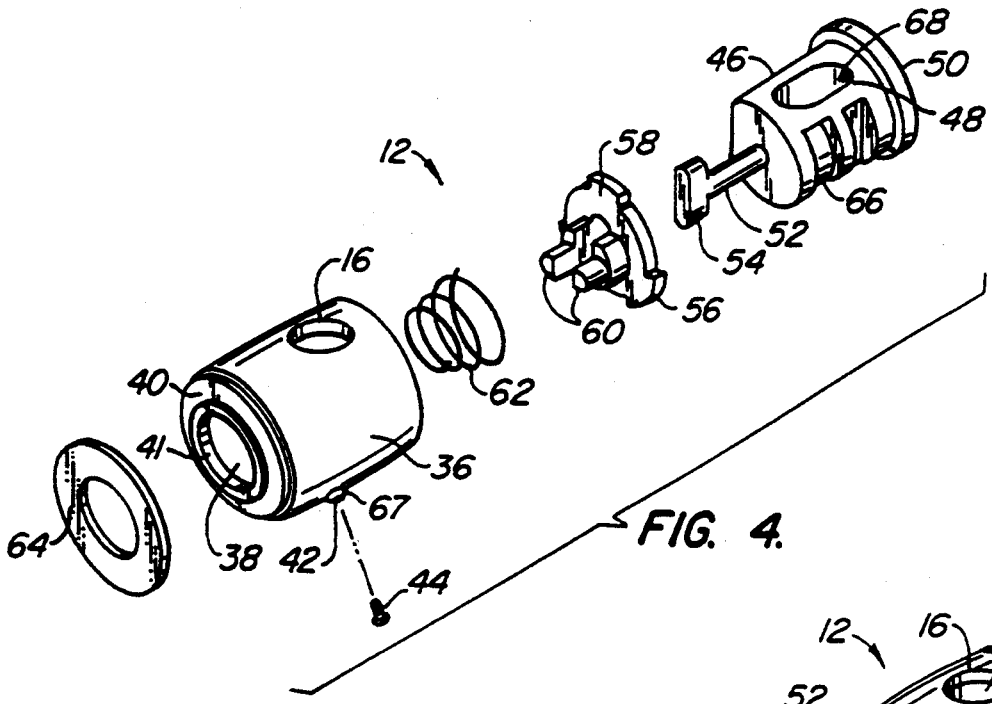
FIG. 4 is an exploded view of the attachment mechanism of FIG. 3.
Figure 3:
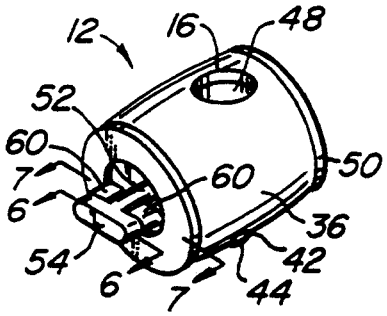
FIG. 3 is a perspective view of the attachment mechanism of the first embodiment.

Attachment mechanism 12 of first embodiment 10 is illustrated in more detail by way of reference to FIGS. 3 and 4 in combination. Mechanism 12 includes a housing 36 having a hollow interior cylindrical cavity 38. An annular plate 40 forms one end of housing 36 and has an aperture 41. A pair of apertures such as aperture 16 are located on opposite sides of housing 36. A small raised aperture 42 is also provided in housing 36 to accommodate a pin 44, as explained in more detail hereinafter.

A spindle 46 includes a cylindrical portion 48 adapted to fit within the cylindrical cavity of housing 36. Spindle 48 includes a raised plate 50 at one end which forms the aft end of the mechanism when assembled as illustrated in FIG. 3. Spindle 46 also includes a shaft 52 extending outwardly through the aperture 41 in housing 36. A crossmember 54 is located on the distal end of shaft 52.

An abutment mechanism 56 includes an abutment plate 58 designed to be received within the cylindrical interior cavity of housing 36, and a pair of pins 60 adapted to extend outwardly through the aperture 41 in housing 36. A spring 62 biases abutment plate 58 and spindle 46 rearwardly when the mechanism is assembled, as illustrated in FIG. 3. A plastic bushing 64 designed to prevent scarring of the equipment to which mechanism 12 is attached is affixed to the plate 40 on housing 36 circumscribing aperture 41.

When mechanism 12 is assembled as illustrated in FIG. 3, crossmember 54 and shaft 52, together with pins 60 on either side of the shaft, extend outwardly beyond housing 46 through aperture 41. Pin 44 engages a groove 66 in spindle 46 so that the mechanism cannot be disassembled without removing the pin. The head of pin 44 is conformed to the shape of a boss 67 on the surface of housing 36 so that the pin cannot be removed without special equipment. Groove 66 has a preselected width allowing limited axial movement of spindle 46 relative to housing 36 with pin 44 engaged so that the axial position of crossmember 54 relative to the housing is somewhat adjustable. Spring 62 biases plate 58 and spindle 46 rearwardly to bias crossmember 54 toward housing 36.

Groove 66 extends around about 25% of the periphery of spindle 46 so that the spindle can be rotated approximately 90° relative to the housing. A transverse aperture 68 through the cylindrical portion 48 of spindle 46 is aligned with aperture 16 in housing 36 when crossmember 54 is misaligned from pin 60 (see FIG. 4). With spindle 46 rotated 90°, as allowed by pin 44 in groove 68, crossmember 54 is aligned with pin 60, and aperture 68 is not aligned with aperture 16. Cable 18 (see FIG. 1) can only be inserted through the aligned apertures 16, 68 when crossmember 54 is misaligned with pins 60, i.e., when attachment mechanism 12 is attached to the piece of equipment, as explained hereinbelow. With cable 18 passing through aligned apertures 16 and 68, rotation of spindle 46 so as to align crossmember 54 with pins 60 and allow removal of the attachment mechanism is effectively prevented.

Figure 5:
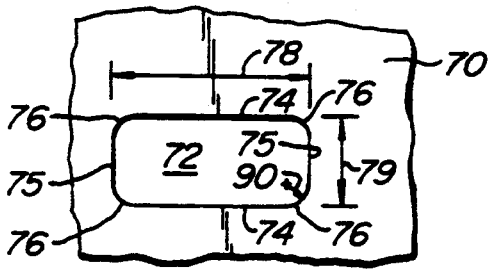
FIG. 5 is a fragmentary elevation view of a slot in a piece of equipment specially designed to accept the attachment mechanism of either embodiment of the present invention.

The preferred embodiments 10 and 26 of the present invention are designed to operate with items of equipment provided by a special slot, as illustrated in FIG. 5. The exterior wall 70 of the piece of equipment is typically made of sheet metal, or molded plastic, either of which is compatible with the present invention. A relatively small slot 72 is formed in wall 70, by molding or otherwise as appropriate. In the preferred embodiment of slot 72, the slot has a generally rectangular configuration, i.e., the slot is generally rectangular having long parallel sides 74, short parallel shoes 75 and rounded corners 76. Slot 72 is relatively small, having a long dimension 78 of seven millimeters, and a short dimension 79 of three millimeters, in the preferred embodiment of the present invention. Corners 76 have a radius of curvature 90 from 0.30 mm. to a maximum of 1.5 millimeters. If the radius of curvature 90 is 1.5 mm., the short sides 75 disappear and the slot has a straight-sided oval configuration.

Figure 6:
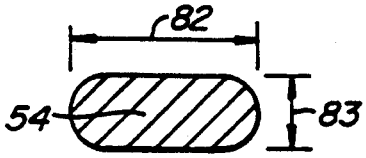
FIG. 6 is a section view taken along lines 6—6 of FIG. 3.
Figure 7:
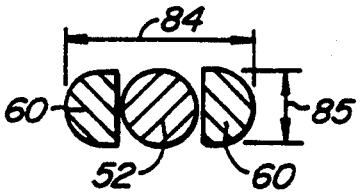
FIG. 7 is a section view taken along lines 7—7 of FIG. 3.

The peripheral dimensions of crossmember 54 are closely conformed to the interior dimensions of slot 72, as illustrated in FIG. 6. The crossmember 4 of attachment mechanism 12 has a straight-sided oval configuration, i.e., the crossmember is generally rectangular, having straight sides and semi-circular ends. In the preferred embodiment, the long dimension 82 of crossmember 54 is 6.75 millimeters, while the short dimension 83 is 2.75 millimeters, each being slightly less than the corresponding dimension of slot 72. As illustrated in FIG. 7, the peripheral dimensions of the pins 60 and shaft 52 also closely conform to the interior dimensions of slot 72. As with crossmember 54, pins 60 in shaft 52 have a long dimension 84 of 6.75 millimeters, and a short dimension 85 of 2.75 millimeters.

Figure 8:
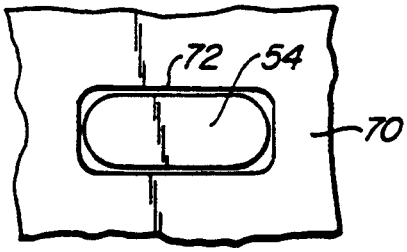
FIG. 8 is a fragmentary section view from inside an item of equipment illustrating insertion of a crossmember of the embodiment of FIG. 3 into the slot of FIG. 5.
Figure 10A:
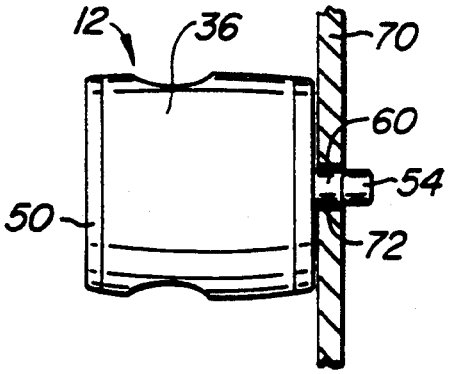
FIGS. 10*d* are elevation views illustrating the installation of the attachment mechanism of FIG. 3 on an item of equipment.

The insertion of crossmember 54 of attachment mechanism 12 into slot 72 of external wall 70 is illustrated by reference to FIGS. 8 and 10A. Before insertion, spindle 46 must be rotated so that crossmember 54 is aligned with pins 60, as illustrated in FIG. 3. With the spindle in this position, the periphery of crossmember 54 and that of pins 60 and shaft 52 are essentially congruent. Since the peripheral dimension of crossmember 54 and pins 60 and shaft 52 in combination are less than the dimensions of slot 72, the crossmember can be inserted through the slot until crossmember 54 is completely inside wall. 70 (see FIG. 10A). If necessary, the plate 50 spindle 46 can be pressed to compress spring 62 so that crossmember 54 is completely inside wall 70.

Figure 9:
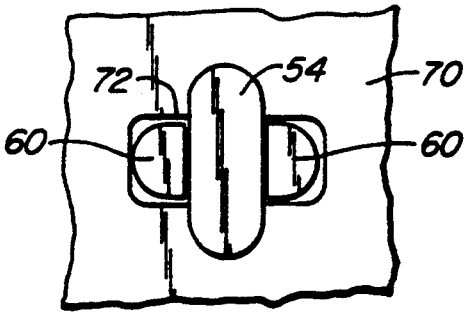
FIG. 9 is a view similar to that of FIG. 8 with the crossmember misaligned.

As illustrated in FIG. 9, upon insertion of crossmember 54 completely through slot 72, the spindle is rotated by manipulating plate 50 so that crossmember 54 is 90° misaligned with respect to pins 60. The aperture 16 in the side wall of housing 36 will be aligned with the aperture 68 in the spindle, providing a passageway completely through the housing. In this configuration, cable 18 can easily be threaded through the aperture, and the presence of the cable prevents the spindle from being rotated back so as to disengage crossmember 54 from slot 72.

Figure 12:
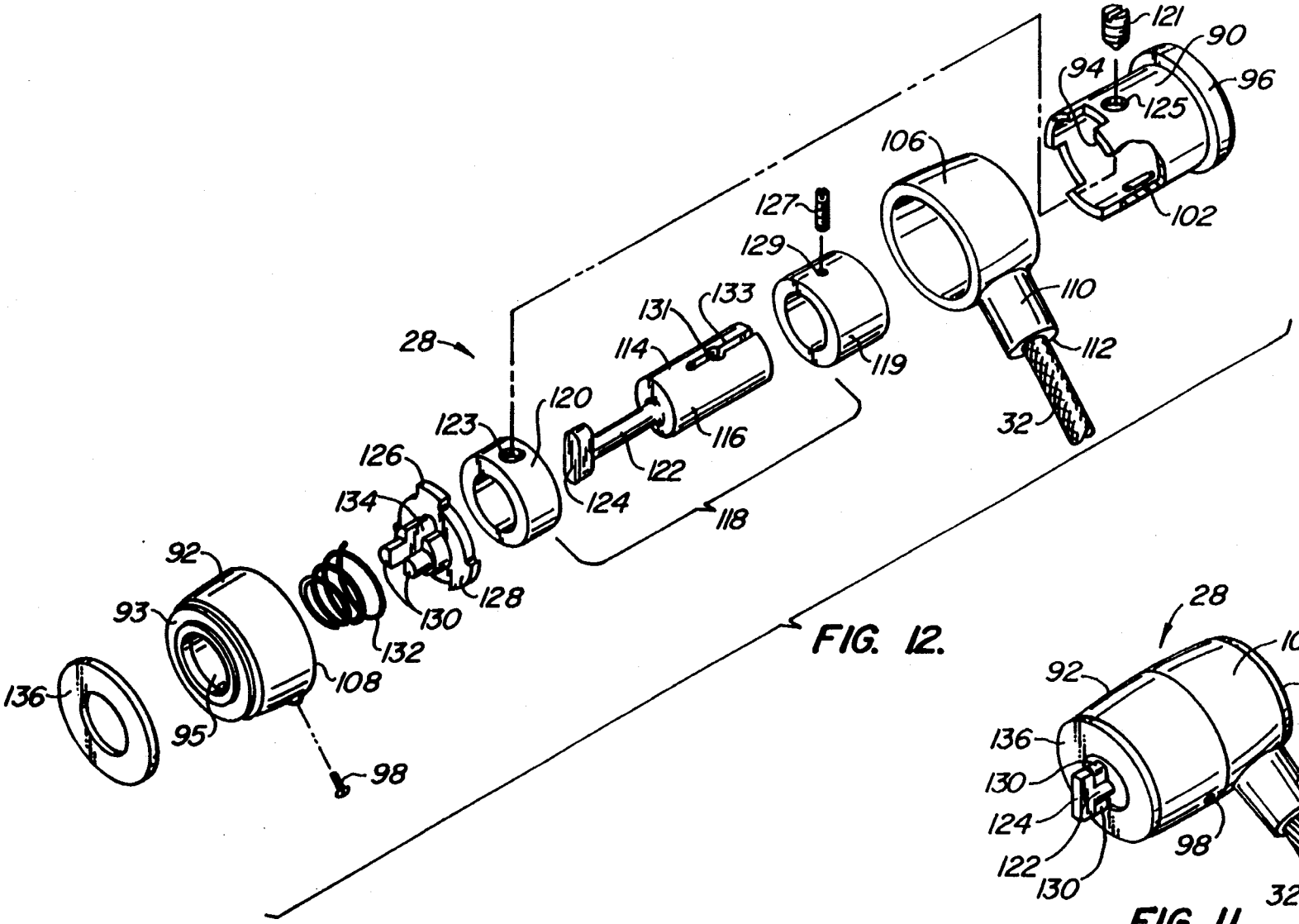
FIG. 12 is an exploded view of the attachment mechanism of FIG. 10.
Figure 11:
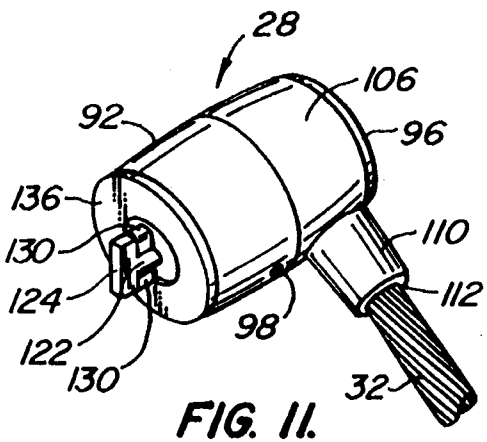
FIG. 11 is a perspective view of the attachment mechanism of the second embodiment of the present invention.

The attachment mechanism 28 of the second embodiment 26 of the present invention is illustrated in more detail by way of reference to the perspective view of FIG. 11 and the exploded view of FIG. 12. Attachment mechanism 28 includes a hollow shell 90 and a nose-piece 92 which, in combination, form a housing. Shell 90 has a hollow cylindrical interior cavity 94, and an integral apertured plate 96 at one end. A pin 98 is inserted through an aperture (not shown) in nose-piece 92 to engage a slot 102 in shell 90. Pin 98 is designed to shear when torque is applied to nose-piece 92 so that an unauthorized attempt to remove the attachment mechanism will simply shear the pin and allow the nose-piece to freely rotate without degrading the attachment of the attachment mechanism to the component to be protected. Slot 102 is axially elongate so that limited axial movement is allowed between shell 90 and nose-piece 92. The forward end of nose-piece 92 has a plate 9 having a central aperture 95.

A cylindrical collar 106 circumscribes the outer portion of shell 90 and occupies the slot laterally defined by plate 96 and the aft surface 108 of nose-piece 92. Collar has an integral tab 110 with an aperture 112 adapted to receive one end of cable 32. Cable 32 is dead-ended into tab 110 and attached so that it cannot be removed.

A spindle 114 has a cylindrical portion 116 adapted to be received within a cylindrical lock 118 in shell 90. Cylindrical lock 118 includes a front cylinder 119, and a back cylinder 120. A blunt pin or set screw 121 is inserted through an aperture 125 in shell 90, and through a corresponding aperture 123 in back cylinder 120, to lock the front cylinder rotationally with respect to shell 90. Correspondingly, pin or set screw 127 engages a relatively smaller aperture 129 in front cylinder 119, and a widening 131 in slot 133 in the cylindrical portion 116 of spindle 114. Front cylinder 119 is thus fixed rotationally with respect to spindle 114.

As with conventional cylindrical locks, a plurality of pins normally span the interface between front cylinder 119 and back cylinder 120 so that the cylinders are rotationally locked together, thus preventing relative rotation between locking shell 90 and spindle 114. However, a key 140 (see FIG. 13B) is insertable through the apertured plate 96 of shell 90 to engage front cylinder 119. The correct key will have bosses located to depress the pins passing between cylinders 119 and 120 so that such pins do not span the interface between the cylinders, allowing the cylinders to rotate with respect to one another. In this fashion, spindle 114 can be rotated with respect to shell 90 only upon insertion and rotation of the appropriate key.

Spindle 114 also includes a shaft 122, and a crossmember 124 at the free end of the shaft. An abutment mechanism 126 has an abutment plate 128 adapted to fit within nose-piece 92, and a pair of pins 130 adapted to extend outwardly through aperture 95. A spring 132 is located between abutment plate 128 and nose-piece 92 to bias the cylindrical portion 116 of spindle 114 and the abutment plate rearwardly. Abutment plate 126 has an elongate aperture 134 which allows crossmember 124 to extend through the aperture plate. A plastic bushing 136 is fixed to the surface of plate 93 so that the mechanism does not scar the equipment to which it is attached.

The insertion of attachment mechanism 28 into the exterior wall 137 of a piece of equipment is illustrated by way of reference to FIGS. 13 A and B. Wall 136 has a slot 138, which is identical to the slot 72 illustrated in FIG. 8. The peripheral dimensions of crossmember 124, and also those of pins 130 and shaft 122 in combination, are identical to the corresponding parts in FIGS. 6 and 7. Simply put, attachment mechanism 28 is designed to fit into the same slot as attachment mechanism 12.

Figure 13A:
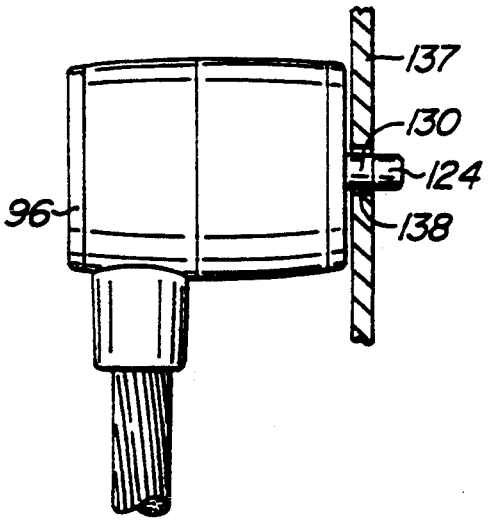
FIGS. 13 and B are side elevation views illustrating the installation of the attachment mechanism of FIG. 11 on an item of equipment.
Figure 10B:
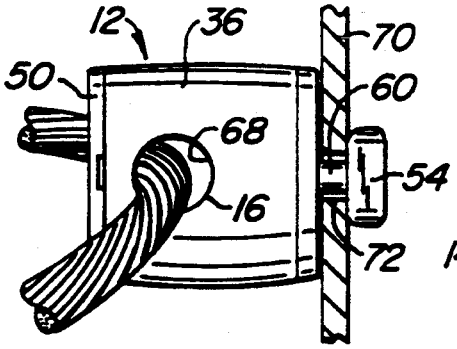
Figure 13B:
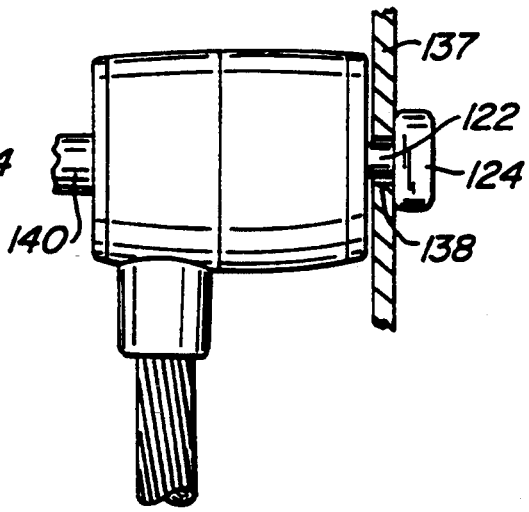

As illustrated in FIG. 13A, crossmember 124 is aligned with pins 30 so that the crossmember can be inserted into slot 138. When fully inserted, the space in the slot is essentially occupied by pins 130 and shaft 122. If necessary, plate 96 can be depressed to push the cylindrical portion 116 of spindle 114 against spring 132. Once crossmember 124 has been fully inserted through slot 138, a key 140 engaging lock mechanism 118 (see FIG. 12) is used to rotate the spindle 90° and misalign crossmember 124 and slot 138.

In operation, both attachment mechanism 12 and attachment mechanism 28 are attached to an item of computer or other equipment which has a specially designed slot 72, 138. First, the crossmember 54, 124 is aligned with the pins 60, 130, for insertion to the crossmember through the slot. The spindle 46, 114 is then rotated relative to the housing to misalign the crossmember 54, 124 relative to the slot. The spindle is locked in this configuration by passing the cable 18 through the mating slot 16, 48 in the first embodiment, or using the key 140 in the second embodiment. Either way, the attachment mechanism is extremely difficult to disengage by anyone not having the appropriate key 24, 140. Any unauthorized attempt to remove the attachment mechanism from the computer component will most likely result in significant damage to the computer housing, making the computer difficult to resell and greatly reducing its theft potential.

While two embodiments of the present invention have been illustrated by way of example, it is apparent that further embodiments could be developed within the spirit and scope of the present invention. However, it is to be expressly understood that such modifications and adaptations are within the spirit and scope of the present invention, as set forth in the following claims.

What is claimed is:

1. Apparatus for inhibiting theft of equipment having an external wall with a thickness,, the wall provided with a specially designed generally rectangular slot having preselected internal dimensions, comprising:

an attachment mechanism including a housing, a spindle including a first portion rotatably mounted within the housing, a shaft fixed to the first portion and extending outwardly from the housing, and a crossmember at the distal end of the shaft, the peripheral dimensions of the crossmember conforming closely to the preselected internal dimensions of the slot and the length of the shaft external to the housing being approximately equal to the thickness of the external wall, and abutment means emanating from the housing and located on opposite sides of the shaft intermediate the housing and the crossmember wherein the abutment means includes a pin late circumscribing the shaft and attached to the housing, and pin members integral to and projecting from the pin plate on opposite sides of the shaft and the crossmember and having cross-sectional dimensions, the cross-sectional dimensions of the abutment means and the shaft in combination closely conforming to the dimensions of the slot so that the crossmember, the shaft and the abutment means are insertable into the slot with the crossmember aligned with the abutment means to a position in which the crossmember is inside the external wall and the abutment means and the shaft occupy the slot, and the spindle is then rotatable 90 degrees to misalign the crossmember with the slot to attach the attachment mechanism rigidly to the external wall; and a cable including means for connecting to an immovable object and adapted to be secured to the housing to inhibit theft of the equipment.

2. The apparatus of claim 1 wherein the pin members each have a partially circular cross-section.

3. The apparatus of claim 1 wherein the pin plate includes an aperture conforming to the peripheral dimensions of the crossmember.

4. Apparatus for securing a plurality of pieces of equipment together to inhibit theft, each said piece having a specially designed generally rectangular slot formed in the external wall Thereof, comprising:

a plurality of attachment mechanisms each including a housing having a generally cylindrical interior chamber and a transverse aperture, the spindle having a first portion with a generally cylindrical periphery rotatable in said chamber, a shaft extending axially outwardly from the housing, and a crossmember at the distal end of the shaft having a periphery generally conformed to the shape of the slot, and abutment means extending from the housing on opposite sides of the shah so that the shaft and abutment means have a cross-section generally conformed to the shape of the slot, the first portion of the spindle having a transverse aperture aligned with the aperture in the housing when the crossmember is rotated approximately 90 degrees with respect to the abutment means; and a cable adapted to be inserted through the aligned apertures of the housings and the spindles of the attachment mechanisms after the crossmembers of said mechanisms have been inserted through the slots of respective items of equipment while aligned with the abutment means and then rotated approximately 90 degrees to align the apertures.

5. The apparatus of claim 4 wherein the housing includes a pair of mating shells defining an inner cavity containing the first portion of the spindle.

6. The apparatus of claim 4 wherein the housing additionally includes a spring for biasing the mating shells apart to press one Of the shells against the external wall of the item of equipment.

7. A system for securing a portable object to another object through use of a securing device including a housing securing a spindle rotatably mounted within the housing with the spindle having a shah extending beyond the housing a particular distance, a crossmember coupled to a distal end of the shah, and a pin plate intermediate the crossmember and the housing, the system comprising:

a wall for the portable object having a thickness less an the particular distance, said wall including a portion defining a slot adapted for receipt of said crossmember and a pin of the pin plate when the crossmember and the pin have a first relative relationship, said portion positioned so that the crossmember may be rotated on a side of the wall opposite from the housing of the securing device to define a second relative relationship between the crossmember and the pin of the pin plate, and wherein the pin engages said slot to inhibit rotation of the crossmember relative to said slot to inhibit extraction of the crossmember from said slot until the crossmember and the pin are returned to said first relative relationship.

8. Apparatus for attaching a security cable to a piece of equipment having an external wall provided with a specially designed rectangular slot having preselected internal dimensions, comprising:

a housing having an aperture through which the security cable is adapted to pass to secure the housing to the cable;

a spindle including a first portion rotatably mounted within the housing, a rotatable shaft fixed to the first portion and extending outwardly from the housing, and a crossmember at the distal end of the shaft having peripheral dimensions, the peripheral dimensions of the crossmember conforming closely to the preselected internal dimensions of the slot and the length of the shaft external to the housing being approximately equal to a thickness of the external wall; and abutment means emanating from the housing and located on opposite sides of the shaft intermediate the housing and the crossmember wherein the abutment means includes a pin plate attached to the housing, and pin members projecting from the pin plate on opposite sides of the shah, the abutment means having cross-sectional dimensions that in combination with the shaft closely conform to the preselected internal dimensions of the slot so that the crossmember, the shaft and the abutment means are insertable into the slot with the crossmember aligned with the abutment means to a position in which the crossmember is inside the external wall and the abutment means and the shaft occupy the slot, and the spindle is then rotatable 90 degrees to misalign the crossmember with the slot to attach the locking mechanism rigidly to the external wall.

9. The apparatus of claim 8 wherein the pin members each have a partially circular cross-section.

10. The apparatus of claim 8 wherein the pin plate includes an aperture conforming to the peripheral dimensions of the crossmember.

11. Apparatus for inhibiting theft of equipment having an external wall with a thickness, the wall provided with a specially-designed, generally rectangular slot having preselected internal dimensions, comprising:

an attachment mechanism including a housing having a first transverse aperture, a spindle including a first portion rotatably mounted within the housing and including a second transverse aperture in said first portion, a shaft fixed to the first portion and extending outwardly from the housing, and a crossmember at the distal end of the shaft, the peripheral dimensions of the crossmember conforming closely to the preselected internal dimensions of the slot and the length of the shaft external to the housing being approximately equal to the thickness of the external wall, and abutment means emanating from the housing and located on opposite sides of the shaft intermediate the housing and the crossmember and having cross-sectional dimensions, the cross-sectional dimensions of the abutment means and the shaft in combination closely conforming to the dimensions of the slot so that the crossmember, the shaft and the abutment means are insertable into the slot with the crossmember aligned with the abutment means to a position in which the crossmember is inside the external wall and the abutment means and the shaft occupy the slot, and the spindle is then rotatable 90 degrees to misalign the crossmember with the slot to attach the attachment mechanism rigidly to the external wall and to align said first aperture and said second aperture; and a cable including means for connecting to an immovable object and adapted to be secured to the housing to inhibit theft of the equipment, said cable adapted to extend through said aperture to prevent rotation of said spindle.

12. Apparatus for attaching a security cable to a piece of equipment having an external wall provided with a specially designed generally rectangular slot having preselected internal dimensions, comprising;

a housing having an aperture through which the security cable is adapted to pass to secure the housing to the cable;

a spindle including a first portion rotatably mounted within the housing, a rotatable shaft fixed to the first portion and extending outwardly from the housing, and a crossmember at the distal end of the shaft having peripheral dimensions, the peripheral dimensions of the crossmember conforming closely to the preselected internal dimensions of the slot and the length of the shaft external to the housing being approximately equal to a thickness of the external wall and abutment means emanating from the housing and located on opposite sides of the shaft intermediate the housing and the crossmember, the abutment means having cross-sectional dimensions that in combination with the shaft closely conform to the preselected internal dimensions of the slot so that the crossmember, the shaft and the abutment means are insertable into the slot with the crossmember aligned with the abutment means to a position in which the crossmember is inside the external wall and the abutment means and the shaft occupy the slot, and the spindle is then rotatable 90 degrees to misalign the crossmember with the slot to attach the locking mechanism rigidly to the external wall, wherein the aperture in the housing is transverse to the axis of the spindle, and the first portion of the spindle includes an aperture aligned with the aperture in the housing when the crossmember is misaligned 90 degrees from the slot, the cable extending through both the aperture in the housing and the aperture in the spindle to prevent rotation of the spindle.

13. Apparatus for inhibiting the theft of equipment having an external wall provided with a specially designed generally rectangular slot having preselected dimensions, comprising:

an attachment mechanism including a pair of mating shells forming a housing having a peripheral groove and a spring biasing the shells apart, a collar member having a cylindrical portion rotatably circumscribing the groove and a tab portion including an aperture, a spindle having a first portion rotatable in the housing, a shah extending outwardly from the housing, and a crossmember at the distal end of the shaft having peripheral dimensions generally conformed to the dimensions of the slot, a locking mechanism intermediate the housing and the spindle and actuatable by a key to prevent relative rotation of the spindle and housing, and abutment means extending outwardly from the housing on opposite sides of the shah so that the abutment means and shaft in combination have a cross-section generally conformed to the dimensions of the slot; and a cable having a loop formed in one end and having the other end dead ended into and permanently fixed to the aperture in the collar member so that the attachment mechanism can be fixed to the external wall by aligning the crossmember with the abutment means and inserting the crossmember through the slot, and the spindle rotated to misalign the crossmember and the slot and the locking mechanism actuated to lock the spindle in position to secure the cable to the equipment, wherein the mating shells are joined by a pin, said pin having a limited shear strength so that torque applied to one of the shells in an attempt to dislodge it will shear the pin and allow said shell to rotate,

14. A locking device for attaching to a security slot in a portable device, comprising:

a housing having a first transverse aperture;

a spindle rotationally mounted within said housing and including:

a first portion provided with a second transverse aperture:

a shaft fixed to said first portion and extending outwardly from said housing; and a crossmember at a distal end of said shah outside of said housing, said crossmember having a perimeter shape conforming to the security slot; and an abutment member emanating from said housing and located on opposite sides of said shaft intermediate said housing and said crossmember for maintaining a fixed rotational relationship between said housing and the security slot when said abutment member is inserted within the portable device, wherein said crossmember and said abutment member are insertable within the security slot when said crossmember is aligned with the security slot and said first aperture and said second aperture are misaligned, with said crossmember retained within the security slot when said crossmember is misaligned with the security slot and said first aperture and said second aperture are aligned to permit an object to extend through both said first aperture and said second aperture to inhibit alignment of said crossmember and the security slot while said object extents through said apertures.

15. A method for attaching a locking device to a security slot in a wall of a portable device, comprising the steps of:

inserting a spindle including a shaft having a slot-conforming crossmember fixed to a distal end of said shaft into the security slot when said spindle is in an unlocked position with said crossmember being aligned with the slot;

inserting an abutment member, emanating from a housing holding a first portion of said spindle, into the slot to thereby fix a relative rotational orientation between said housing and the security slot;

misaligning said crossmember and the security slot by rotating said spindle to a locked position wherein said spindle is retained within the portable device, wherein a first transverse aperture in said first portion of said spindle is aligned with a second transverse aperture in said housing; and holding said spindle in said locked position relative to said housing by passing an object through said first aperture and said second aperture while they are aligned to maintain alignment of said transverse apertures.

16. The attaching method of claim 5 wherein said object is a cable and said attaching method further comprises the step of attaching said cable to a second object other than the portable device.

17. In combination with a portable electronic device having a portion of an external wall defining a generally rectangular security slot, the security slot having a width and a length different from the width, an apparatus comprising:

an attachment mechanism, including:

a housing;

a spindle having:

a first portion contained within said housing;

a shaft fixed to said first portion and extending outwardly from said housing; and crossmember at a distal end of said shaft outside of said housing, said crossmember having a perimeter shape conforming to the rectangular security slot;

a locking mechanism for maintaining rotation of said shah of said spindle fixed relative to said housing; and an abutment mechanism emanating from said housing and located on opposite sides of said shaft intermediate said housing and said crossmember, said abutment mechanism including:

a pin plate circumscribing said shaft and coupled to said housing, said pin plate including a pair of pin members projecting from said pin plate on opposite sides of said shaft towards said crossmember, with said pair of pin members and said shaft together having a cross-sectional perimeter conforming to the rectangular security slot, wherein said crossmember is insertable within the security slot when aligned with the security slot and wherein said crossmember resists removal from the security slot when misaligned with the security slot, and wherein said pin members and shah fill the security slot when said crossmember is misaligned and maintain a rotational orientation of said pin plate fixed relative to the security slot.

18. A method for inhibiting theft of a portable device provided with a specially designed generally rectangular slot in an external wall of the portable device, the slot having preselected peripheral dimensions, the method employing an attachment mechanism having a housing with a first transverse aperture, a rotatable shaft extending outwardly from the housing and having a crossmember at a distal end of the rotatable shaft wherein a portion of the shah inside the housing includes a second transverse aperture, the crossmember having peripheral dimensions generally conformed to the shape of the slot, the attachment mechanism including an abutment mechanism circumscribing the shah, comprising the steps of:

inserting the crossmember through the slot into the interior of the equipment;

filling the slot with the abutment mechanism and the shaft while the crossmember is inserted through the slot to inhibit rotation of the attachment mechanism;

rotating the shaft while the crossmember is inserted through the slot to misalign the crossmember and the slot to thereby prevent withdrawal of the crossmember through the slot wherein said rotating step also aligns the first transverse aperture with the second transverse aperture;

maintaining the rotary position of the shaft fixed relative to the slot by use of the abutment mechanism with the crossmember misaligned with the slot and by passing a cable through both the first transverse aperture and the second transverse aperture while they are aligned; and securing the locking device to an object other than the portable device by use of the cable to inhibit the theft of the portable device.

19. In combination with a portable electronic device having a portion of an external wall defining a generally rectangular security slot, the security slot having a width and a length different from the width, an apparatus comprising:

an attachment mechanism, including:

a housing;

a spindle having:

a first portion contained within said housing;

a shaft fixed to said first portion and extending outwardly from said housing; and a crossmember at a distal end of said shaft outside of said housing, said crossmember having a perimeter shape conforming to the rectangular security slot; and an abutment mechanism emanating from said housing and located on opposite sides of said shaft intermediate said housing and said crossmember, said abutment mechanism including:

a pin plate circumscribing said shaft and coupled to said housing, said pin plate including a pair of pin members projecting from said pin plate on opposite sides of said shaft towards said crossmember, with said pair of pin members and said shaft together having a cross-sectional perimeter conforming to the rectangular security slot, wherein said attachment mechanism further includes a locking mechanism for maintaining rotation of said shaft of said spindle fixed relative to said pin plate, and wherein said crossmember is insertable within the security slot when aligned with the security slot and wherein said crossmember resists removal from the security slot when misaligned with the security slot, and wherein said pin members and shaft fill the security slot when said crossmember is misaligned and maintain a rotational orientation of said pin plate fixed relative to the security slot.

* * * * *